United States Patent [19]

Tanaka

[11] Patent Number: 4,641,609

[45] Date of Patent: Feb. 10, 1987

[54] CYLINDER HEAD FOR DOHC ENGINE

[75] Inventor: Yoshimichi Tanaka, Hiroshima, Japan

[73] Assignee: Mazda Motor Corporation, Hiroshima, Japan

[21] Appl. No.: 818,361

[22] Filed: Jan. 13, 1986

[30] Foreign Application Priority Data

Jan. 19, 1985 [JP] Japan ..... 50-8097

[51] Int. Cl.[4] ..... F02F 1/38

[52] U.S. Cl. ..... 123/41.82 R; 123/193 H

[58] Field of Search ..... 123/41.82 R, 41.82 A, 123/41.74, 193 H, 193 CH

[56] References Cited

U.S. PATENT DOCUMENTS

| | | | |
|---|---|---|---|
| 3,520,286 | 7/1970 | Ravenel | 123/59 A |
| 3,769,948 | 11/1973 | Feichtinger et al. | 123/41.82 R |
| 3,908,606 | 9/1975 | Toyoda et al. | 123/3 |
| 4,186,706 | 2/1980 | Matsumoto et al. | 123/306 |
| 4,567,859 | 2/1986 | Taguchi et al. | 123/193 H |
| 4,567,860 | 2/1986 | Sugiyama | 123/193 H |

FOREIGN PATENT DOCUMENTS

| | | |
|---|---|---|
| 47-24533 | 8/1972 | Japan . |
| 1032927 | 6/1966 | United Kingdom . |
| 1256401 | 12/1971 | United Kingdom . |

*Primary Examiner*—William A. Cuchlinski, Jr.
*Attorney, Agent, or Firm*—Burns, Doane, Swecker & Mathis

[57] ABSTRACT

A cylinder head for a multicylinder DOHC internal combustion engine comprises an upper deck for supporting a pair of spaced camshafts for driving intake and exhaust valves and having spark plug wells equal in number to the cylinders in the engine. The upper deck is integrally formed with a row or tubular columns for surrounding the respective spark plugs. Each neighboring columns are connected together by means of a connecting rib extending longitudinally of the engine for impart a rigidity to the cylinder head effective to resist against the tendency of a cylinder head to warp in a direction longitudinally of the engine.

16 Claims, 4 Drawing Figures

7
2
10
5
3
4

1
8a
8b
Ca
Cb
2
12
7
6
17
11
13
18
III
IV
9a
9b
14

CYLINDER HEAD FOR DOHC ENGINE

BACKGROUND OF THE INVENTION

The present invention generally relates to a cylinder head construction for an internal combustion engine and, more particularly, to the cylinder head construction for a multicylinder DOHC (double overhead camshaft) automobile engine of a type having spark plugs arranged in line with each other and generally in alignment with longitudinal axes of respective combustion chambers with camshafts positioned on respective sides of the row of the spark plugs.

The multicylinder DOHC automobile engine is not a recent development and is well known in the art. In general, the multicylinder DOHC engine employs a cylinder head supporting a pair of spaced camshafts and carrying spark plugs in a row intermediate of the space bewteen the camshafts and generally in concentric relationship with the respective combustion chambers. For avoiding contamination of each of the spark plugs with lubricant oil applied to various movable parts of a valve drive mechanism inlcuding the associated overhead crankshaft, it is known to surround each spark plug with a tubular member such as shown in, for example, Japanese Utility Model Publication No. 47-24533 published Aug. 2, 1972; British Patent Specifications No. 1,032,927 and No. 1,256,401, published June 15, 1966 and Dec. 8, 1971, respectively; and U.S. Pat. Nos. 3,520,286, 3,908,606 and 4,186,706, issued July 14, 1970, Sept. 30, 1975 and Feb. 5, 1980, respectively. However, of these publications, only British Patent Specification No. 1,256,401 positively describes the details of the tubular member for each spark plug and, according to it, the tubular member comprises a thin-walled tube separate from, but pressure fitted into a corresponding spark plug well of, the cylinder head.

Regardless of whether the tubular member is separate from the cylinder head construction or whether it is integrally formed with, and hence, an integral part of, the cylinder head construction, the tubular members one for each spark plug disclosed and suggested in any one of the above mentioned publications project upwardly from an upper deck of the cylinder head generally independently from each other. This, and a problem inherent therein, will be discussed with particular reference to FIG. 1 of the accompanying drawings, which illustrates one example of a prior art cylinder head in longitudinal sectional representation.

The prior art cylinder head shown therein has upper and lower decks 2 and 3, front and rear walls and a pair of opposite side walls, the walls being integrally formed with each other and also with the lower deck 3 to provide a generally rectangular container-like configuration. The lower deck 3 has portions each defining a top wall of the associated combustion chamber 4 and carries spark plugs 5 equal in number to the combustion chambers in the engine. A space between the upper and lower decks 2 and 3 provides a coolant passage 10 forming a part of any known engine cooling system. The tubular members, one for each spark plug 5, are generally identified by 7 and extend upwardly from the upper deck 2 so as to surround the respective spark plugs 5.

In this prior art cylinder head, as a matter of fact, the lower deck 3 is apt to be heated to a temperature much higher than the upper deck 2 is heated, even though the cylinder head is forcibly cooled by the flow of the cooling water. This is because the lower deck 3 is partially exposed direct to heat eveolved by the combustion of air-fuel mixture taking place cyclically in the combustion chamber. This differentiated heating of the upper and lower decks permits the lower deck to undergo a thermal expansion more readily than the upper deck and, therefore, the cylinder head as a whole tends to warp in a direction longitudinally thereof as shown by the phantom line in FIG. 1.

Once the tendency of the cylinder head to warp occurs, and unless the cylinder head is firmly bolted to the cylinder block, front and rear ends of the cylinder head will separate from corresonding end portions of the cylinder block with gases inside the adjacent combustion chambers consequently permitted to partially leak to the outside. Moreover, the longitudinal warp of the cylinder head results in displacement of some of the camshaft bearings relative to the others thereof, thereby hampering a smooth rotation of the camshafts.

SUMMARY OF THE INVENTION

Accordingly, the present invention has been developed with a view to substantially eliminating the above discussed disadvantages and inconveniences inherent in the prior art cylinder head and has for its essential object to provide an improved cylinder head having a rigidity effective to resist any possible deformation which the cylinder head may undergo when placed in severe conditions.

In order to accomplish the above described object, the present invention provides the cylinder head with connecting ribs for connecting each neighboring tubular members together so as to extend in a direction longitudinally of the cylinder head. The tubular members, one for each spark plug, used in the cylinder head embodying the present invention are each in the form of a tubular column integral at one end with the upper deck, and each of the connecting ribs is also an integral part of the cylinder head as formed by the use of a metal casting technique. The front and rear walls of the cylinder head are also connected with respective adjacent tubular columns by means of connecting ribs.

The connecting ribs altogether may be considered as formed a strut extending between the front and rear wall of the cylinder head so as to resist any possible longitudinal warp of the cylinder head. Therefore, with the provision of the connecting ribs, the cylinder head is imparted a rigidity.

BRIEF DESCRIPTION OF THE DRAWINGS

This and other objects and features of the present invention will become clear from the following description taken in conjunction with a preferred embodiment thereof with reference to the accompanying drawings, in which.

DETAILED DESCRIPTION OF THE EMBODIMENT

Figures 1, 2:
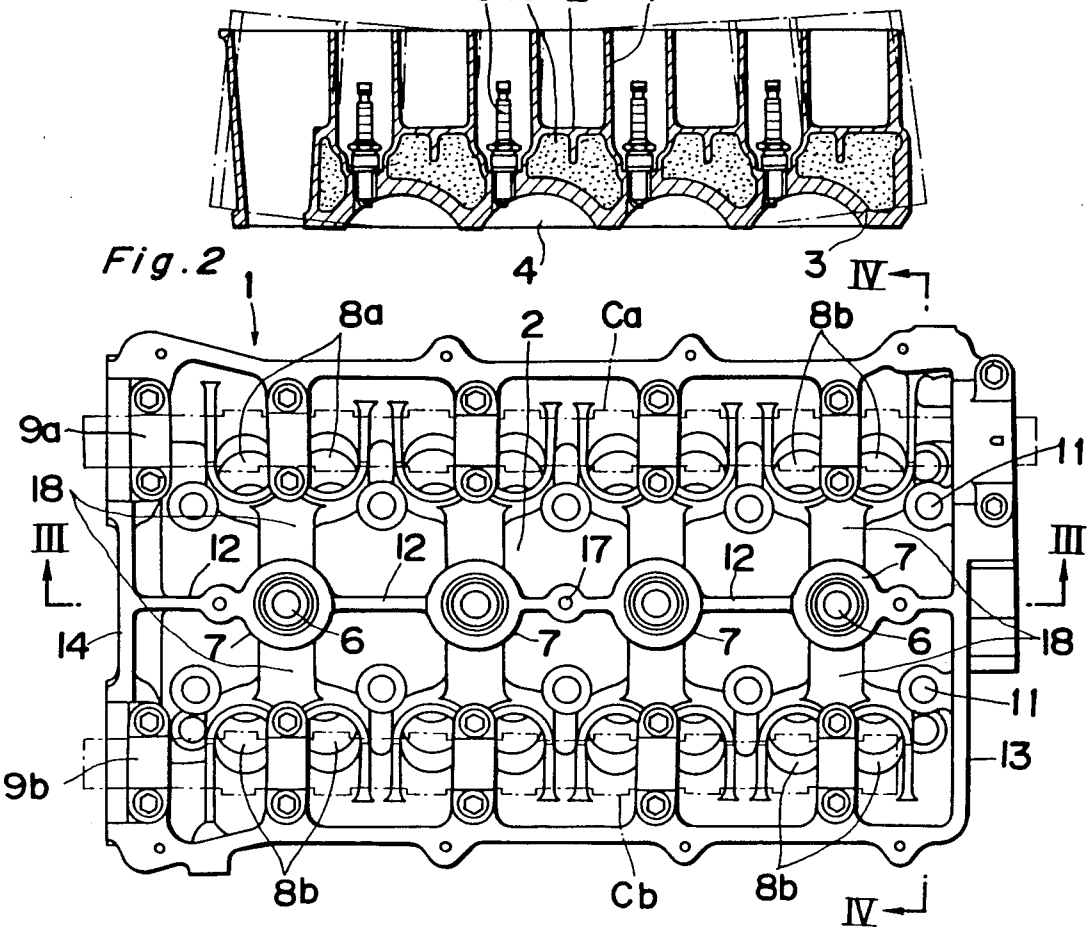
Fig.1 Prior Art
FIG. 1 is a schematic side sectional view of the prior art cylinder head for a four-cylinder internal combustion engine.
FIG. 2 is a top plan view of a cylinder head for a four-cylinder internal combustion engine embodying the present invention.

Before the description of the present invention proceeds, it is to be noted that like parts are designated by like reference numerals throughout the accompanying drawings.

Figure 3:
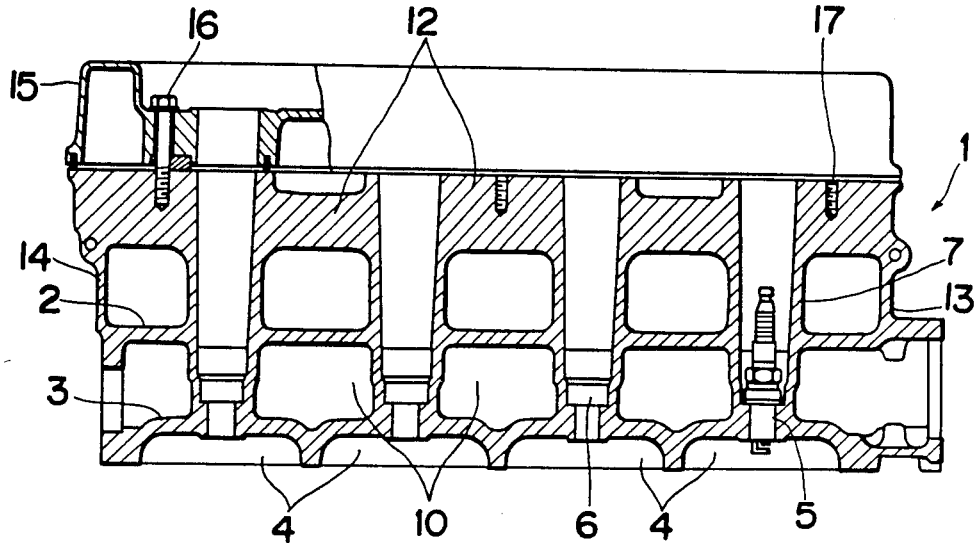
FIG. 3 is a longitudinal cross-sectional view taken along the line III—III in FIG. 2.
Figure 4:
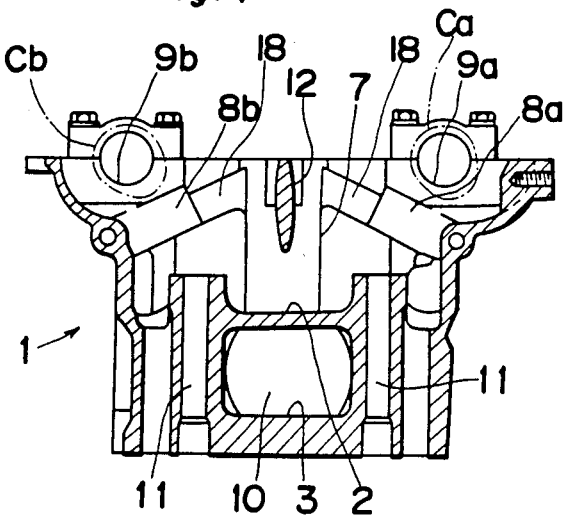
FIG. 4 is a transverse cross-sectional view taken along the line IV—IV in FIG. 2.

Referring to the accompanying drawings, particularly to FIGS. 2 to 4, there is shown a cylinder head 1 for a four-cylinder automobile engine. The illustrated cylinder head 1 is generally rectangular in shape and has an upper deck 2 and a lower deck 3 immediately below the upper deck 2 and constituting a top wall for each of the four combustion chambers 4. The lower deck 3 is formed with spark plug holes for receiving respective spark plugs, only one of which is shown in FIG. 3, which spark plug holes are so defined and so positioned in the lower deck 3 that the spark plugs 5 can align substantially with the longitudinal axes of the combustion chambers 4, respectively. The spark plug holes are communicated with respective spark plug wells 6 defined in the upper deck 2 so as to extend downwards to the lower deck 3 in register with the associated spark plug holes, which wells are arranged in a row extending in a direction longitudinally of the cylinder head 1. In order to avoid any possible adherence of oily and oil foreign matter to each of the spark plugs 5, the upper deck 2 is integrally formed with a tubular column 7 for each spark plug well 6, which column 7 extends upwards from the upper deck 2 at right angles to the lower deck 3 and in register with the respective spark plug well 6 so as to surround the associated spark plug 5.

The cylinder head 1 is formed with a pair of intake valve guides 8*a* and a pair of exhaust valve guides 8*b* located on respective sides of each of the tubular columns 7 and is also formed with bearing recesses 9*a* and 9*b* one on each side of each column 7 and positioned above the paired intake and exhaust valve guides. The bearing recesses 9*a* and 9*b* are used for the support of an intake valve drive camshaft, shown by the phantom line Ca, and an exhaust valve drive camshaft, also shown by the phantom line Cb, respectively, in cooperation with clamps for each bearing recess 9*a* or 9*b*. The space defined between the upper deck 2 and the lower deck 3 is utilized as a coolant passage forming a part of any known engine cooling system and through which cooling water flows for cooling the cylinder head 1 as a whole. The cylinder head 1 can be mounted on and bolted to a cylinder block (not shown). For this purpose, a row of bolt holes 11 are formed in the cylinder head 1 on each side of the longitudinal axis of the cylinder head 1 as best shown in FIGS. 1 and 4.

The cylinder head 1 also includes front and rear end walls 13 and 14 extending upwardly from the upper deck 2 and terminating in a plane generally flush with top ends of the respective tubular columns 7, and a pair of opposite side walls each having its opposite ends connected integrally with the front and rear end walls 13 and 14. While each of the tubular columns 7 is connected integrally with, and supported from lateral directions by, the side walls by means of a pair of support members 18 extending radially outwardly from the respective column 7 and terminating in integral connection with the adjacent side walls, each neighboring tubular columns 7 are integrally connected together by means of a respective connecting rib 12 that extends longitudinally of the cylinder head 1, it being, however, to be noted that one of the tubular columns 7 closest to the front end wall 13 and another one of the tubular columns 7 closest to the rear end wall 14 are also integrally connected with the front end wall 13 and the rear end wall 14 by means of similar connecting ribs 12, respectively. All of the connecting ribs 12 are in line with each other. Preferably, each of the connecting ribs 12 is integrally connected at one end with a free end portion of the respective column 7 remote from the upper deck 2. Some of the connecting ribs 12 are formed with respective threaded holes 17 for receiving set bolts 16 for securing a cylinder head cover 15 to the top of the cylinder head 1.

From the foregoing description of the present invention made in connection with the preferred embodiment thereof, it has now become clear that the connecting ribs 12 altogether provide a reinforcement against any possible longitudinal warp of the cylinder head which would result from the difference in amount of thermal expansion between the upper and lower decks.

Moreover, because of the presence of the connecting ribs, a mold assembly used to cast the cylinder head according to the present invention will have an extra runner corresponding in position to all of the connecting ribs and through which molten metal flows, facilitating a substantially uniform distribution of the molten metal to every corner of the mold cavity, with no substantial formation of shrinkage cavities during the subsequent solidification. At the same time, not only can the casting time required to cast the cylinder head be substantially reduced, but also the cylinder head so manufactured can have an improved quality.

The rigidity of the cylinder head against the longitudinal warp can further be increased if the connecting ribs are formed adjacent respective free end portions of the tubular columns remote from the upper deck, and still further be increased if the front and rear walls are integrally connected with the respective adjacent tubular columns by means of the associated connecting ribs.

The formation of the threaded holes in some of the connecting ribs for the securement of the cylinder head cover can make it possible for the cylinder head cover to be secured to the top of the cylinder head with a minimized number of the set bolts.

The employment of the paired support members each having one end integral with the respective tubular column and the other ends terminating at and integral with a respective portion of the cylinder head where the bearing recess is formed is effective to avoid any possibility that one or some of the tubular columns may fall sideways when a compressive force acting in a longitudinal direction acts on one or some of the connecting ribs.

Where each of the tubular columns extends at right angles to the lower deck, the rigidity of the cylinder head with respect to the longitudinal direction thereof can be substantially uniformly increased in a direction widthwise of the cylinder head. Where each of the connecting ribs has a cross-sectional representation generally elongated in a direction parallel to the longitudinal axis of the respective tubular column, each of the neighboring tubular columns can be effectively strutted relative to each other.

Although the present invention has fully been described in connection with the preferred embodiment thereof with reference to the accompanying drawings, it is to be noted that various changes and modifications are apparent to those skilled in the art. By way of example, although in the foregoing description reference has been made to the multicylinder automobile engine of a type having, for each combustion chamber, a pair of intake valves and a pair of exhaust valves, the present invention is equally applicable to a multicylinder engine of a type having, for each combustion engine, a pair of intake valves and one exhaust valve, or having an intake valve and an exhaust valve for each combustion chamber.

Accordingly, such changes and modifications are to be understood as included within the scope of the present invention as defined by the appended claims, unless they depart therefrom.

What is claimed is:

1. A cylinder head of generally elongated configuration for a multicylinder DOHC internal combustion engine having a plurality of cylinders each with a spark plug, and also having a pair of camshafts for driving intake and exhaust valves, respectively, and mounted atop the cylinder head so as to extend in a direction longitudinally thereof in parallel and spaced relationship with each other, which cylinder head comprises:

an upper deck to provide a portion of outer wall for a space of engine coolant;

tubular columns equal in number to the spark plugs, said columns being integrally formed with the cylinder head and outwardly extending from said upper deck so as to surround the respective spark plugs; and a connecting rib for connecting each neighboring columns together, said connecting rib extending in a direction parallel to the longitudinal sense of the cylinder head.

2. The cylinder head as claimed in claim 1, wherein the connecting rib is positioned adjacent a free end of the associated column remote from the cylinder head.

3. The cylinder head as claimed in claim 2, wherein at least some of the connecting ribs have respective threaded holes for receiving set bolts used to secure a cylinder head cover to the cylinder head.

4. The cylinder head as claimed in claim 1, further comprising front and rear walls formed on the upper deck so as to rise transverse to the upper deck, and additional connecting ribs for connecting one of the columns closest to the front wall with the front wall and another one of the columns closest to the rear wall with the rear wall.

5. The cylinder head as claimed in claim 4, wherein all of the connecting ribs are arranged generally in line with each other.

6. The cylinder head as claimed in claim 4, further comprising a pair of side walls and pairs of support members, the number of the pairs of the support members being equal to that of the columns, and each pair of the support members extending radially outwardly from the respective column for the support of such respective columns from said side walls.

7. The cylinder head as claimed in claim 1, further comprising a pair of side walls and pairs of support members, the number of the pairs of the support members being equal to that of the columns, and each pair of the support members extending radially outwardly from the respective column for the support of such respective columns from said side walls.

8. The cylinder head as claimed in claim 7, wherein the engine has for each cylinder the two intake valves and the two exhaust valves, and further comprising first and second series of bearing means for the support of the camshafts, the bearing means of the first series being positioned adjacent and between each two intake valves whereas the bearing means of the second series is positioned adjacent and between each two exhaust valves, and wherein one end of each of the support members remote from the associated column terminates adjacent the adjacent bearing means.

9. The cylinder head as claimed in claim 1, further comprising a lower deck formed on one side of the upper deck adjacent the cylinders, and wherein each of the columns extends at right angles to the lower deck.

10. The cylinder head as claimed in claim 9, wherein each of the connecting ribs has a cross-sectional representation elongated in a direction longitudinally of the respective column.

11. The cylinder head as claimed in claim 1, further comprising a lower deck formed on one side of the upper deck adjacent the cylinders, and wherein each of the connecting ribs has a cross-sectional representation elongated in a direction transverse to the lower deck.

12. The cylinder head as claimed in claim 1, wherein the connecting ribs are positioned between the cam shafts.

13. The cylinder head as claimed in claim 12, further comprising front and rear walls formed on the upper deck so as to rise transverse to the upper deck, and additional connecting ribs for connecting one of the columns closest to the front wall with the front wall and another one of the columns closest to the rear wall with the rear wall, all of the connecting ribs being arranged generally in line with each other.

14. A cylinder head of generally elongated configuration for a multicylinder, overhead camshaft internal combustion engine having a plurality of cylinders each with a spark plug and also having at least one pair of camshafts extending in parallel relation to each other in a direction longitudinally of the engine for driving intake and exhaust valves, respectively, which cylinder head comprises:

upper and lower decks spaced a distance from each other so as to define therebetween a passage for the flow of an engine cooling fluid, said lower deck being adapted to be connected with an engine cylinder block;

front and rear walls and a pair of opposite side walls all surrounding, and integral with, the upper and lower decks, each wall having a portion extended in the opposite side of said lower deck from said upper deck;

said upper deck being formed with spark plug wells for partially receiving the respective spark plugs, each of said wells extending downwards from the upper deck and terminating in integral connection with the lower deck, all of said wells being arranged in line with each other in a direction longitudinally of the engine;

tubular columns equal in number to the spark plugs, each of said columns having one end integral with the upper deck and aligned with the respective well, each of said columns extending upwards from the upper deck so as to surround the respective spark plug received in the associated well;

connecting ribs each connecting each neighboring columns together, each of said connecting ribs having its opposite ends integral with the neighboring columns, respectively, all of said connecting ribs extending longitudinally of the engine and generally intermediate of the space between the camshafts; and a series of bearing portions for supporting each camshaft, each bearing portion being integrally formed with the side wall.

15. The cylinder head as claimed in claim 14, further comprising additional connecting ribs for connecting one of the columns closest to the front wall with the front wall and another one of the columns closest to the rear wall with the rear wall, respectively, each of said additional connecting ribs having its opposite ends integral with the adjacent column and the adjacent wall, respectively.

16. The cylinder head as claimed in claim 15, further comprising a pair of transverse support members for each column, each of the transverse support members extending between the respective column and one of the opposite side walls in a direction perpendicular to the longitudinal sense of the engine.

* * * * *